United States Patent [19]

Luker

[11] Patent Number: 4,682,799

[45] Date of Patent: Jul. 28, 1987

[54] LATCH LOCK MECHANISM

[75] Inventor: Graham J. Luker, Arncliffe, Australia

[73] Assignee: Efco Manufacturing Company Pty, Limited, Australia

[21] Appl. No.: 758,673

[22] PCT Filed: Oct. 19, 1984

[86] PCT No.: PCT/AU84/00213

§ 371 Date: Jun. 10, 1985

§ 102(e) Date: Jun. 10, 1985

[87] PCT Pub. No.: WO85/01771

PCT Pub. Date: Apr. 25, 1985

[30] Foreign Application Priority Data

Oct. 19, 1983 [AU] Australia ..... PG1926

[51] Int. Cl.[4] ..... E05C 21/00

[52] U.S. Cl. ..... 292/169.15; 292/DIG. 27; 70/149

[58] Field of Search ..... 292/169.15–169.18, 292/DIG. 27, 359; 70/472, 149, 218–220

[56] References Cited

U.S. PATENT DOCUMENTS

| | | | |
|---|---|---|---|
| 323,918 | 8/1885 | Crockett et al. | 70/149 X |
| 509,194 | 11/1893 | Carty | 70/149 |
| 1,330,650 | 2/1920 | Pehel | 70/134 |
| 2,529,230 | 11/1950 | Smith et al. | 70/149 |
| 2,593,573 | 4/1952 | Kulbersh | 292/169.16 |
| 4,255,953 | 3/1981 | Dietrich et al. | 292/169.15 X |
| 4,429,556 | 2/1984 | Kambic | 70/149 |

FOREIGN PATENT DOCUMENTS

| | | | |
|---|---|---|---|
| 444803 | 2/1949 | Italy | 70/218 |

*Primary Examiner*—Richard E. Moore

*Attorney, Agent, or Firm*—Leydig, Voit & Mayer

[57] ABSTRACT

A latch lock comprising a latch bolt adapted for movement between a latching and a retracted position, a first part including a boss adapted to be rotated by a door handle, and a second part adapted to move the latch bolt between these positions. A clutch is provided for transmitting rotation of the first part by the door handle to the second part to move the latch bolt to the retracted position when engaged and for freely rotating the first part by the door handle when disengaged. The clutch comprises a lever pivotally connected to the second part and the lever is provided with a spur which can be engaged by pivotal movement of the lever with a recess in the boss of the first part. The lever is biased toward engagement of the spur and recess and is operated to disengage the first and second parts by a locking device. In the locked configuration, the locking device can also operate to prevent movement of the latch bolt by abutment with the second part.

7 Claims, 3 Drawing Figures

LATCH LOCK MECHANISM

TECHNICAL FIELD

This invention relates to a latch lock mechanism. The invention will herein be described with particular reference to locks of the type provided for security either by mounting to or mortising into a door but it will be understood that the invention is not limited to use in door locks.

BACKGROUND ART

Latch locks of the type herein discussed are usually operated by rotation of a spindle extending from the lock case, and in the case of a mortise lock, extending through at least one side of the door. A lever, knob, handle or like door furniture is mounted on the spindle to facilitate operation of the latch. Rotation of the spindle operates a system of cams or levers which withdraws a latch bolt from latching engagement with a latch keeper or slot in the door jamb and permits the door to open. The mechanism is provided with a lock operable for example by rotation of a separate cylinder, which drives a wedge or block into a position which prevents rotation of the spindle and thus prevents retraction of the bolt until the door is unlocked thus removing the wedge or block.

A disadvantage of such mechanisms is that if excessive torque or entry effort is applied to the handle or knob while the mechanism is locked then damage to the mechanism results. To avoid such damage it is commonly practiced to groove the spindle in such a way as to ensure that the spindle shears prior to other parts of the mechanism becoming damaged. While that avoids the need to replace the whole lock it remains necessary for the spindle to be replaced before the mechanism can be operated again. Often the services of a tradesman are required to replace the spindle before access can be given through the doorway.

DISCLOSURE OF INVENTION

An object of the present invention is to avoid the above discussed disadvantages of latch lock mechanisms.

According to the present invention there is disclosed a latch lock comprising:

a latch bolt adapted for movement between a latching and a retracted position, a first part adapted in use to be rotated by a door handle, a second part adapted in use to drive the latch bolt between one of the positions and the other, and clutch means which when engaged transmit drive from the first part to the second and when disengaged allow free rotation of the first part by the door handle.

Preferably, the latch lock further comprises a locking means which when in a locked configuration disengage the clutch means and prevent movement of the latch bolt.

An embodiment of the invention will now be described by way of example only with reference to the accompanying drawings.

BEST MODE OF CARRYING OUT THE INVENTION

Figure 1:
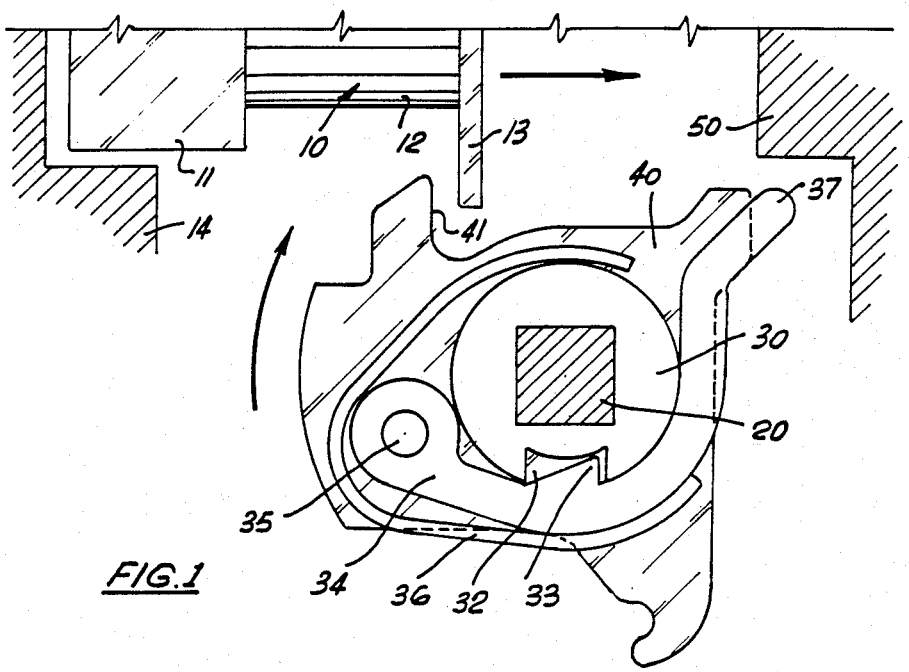
FIG. 1 shows schematically an embodiment according to the invention in a latched unlocked configuration.

The mechanism will first be described in a latched unlocked configuration. With reference to FIG. 1 there is shown a latch lock mechanism comprising a latch bolt 10 having a tongue portion 11, a shaft 12 and a bracket 13 and supported for translational movement by guide means not shown in the drawing. Bolt 10 is spring loaded to a latching position in which bolt 10 extends from a lock case so that tongue 11 may engage a bolt keeper 14.

A square cross-section spindle 20 extends at right angles to the direction of movement of latch bolt 10 and is mounted for axial rotation by, for example, extending through bearings in a lock case. Spindle 20 extends through a square cross section aperture of a boss 30 which is thereby keyed to the spindle and which is thus mounted for rotation by the spindle. A cam 40 is mounted coaxially with spindle 20 for axial rotation about boss 30.

The circumference of boss 30 is provided with a recess 32 adapted to receive a detente or spur 33 provided on a clutch lever 34 pivotally mounted to cam 40 by means of a pin 35 adjacent one lever end.

Figure 2:
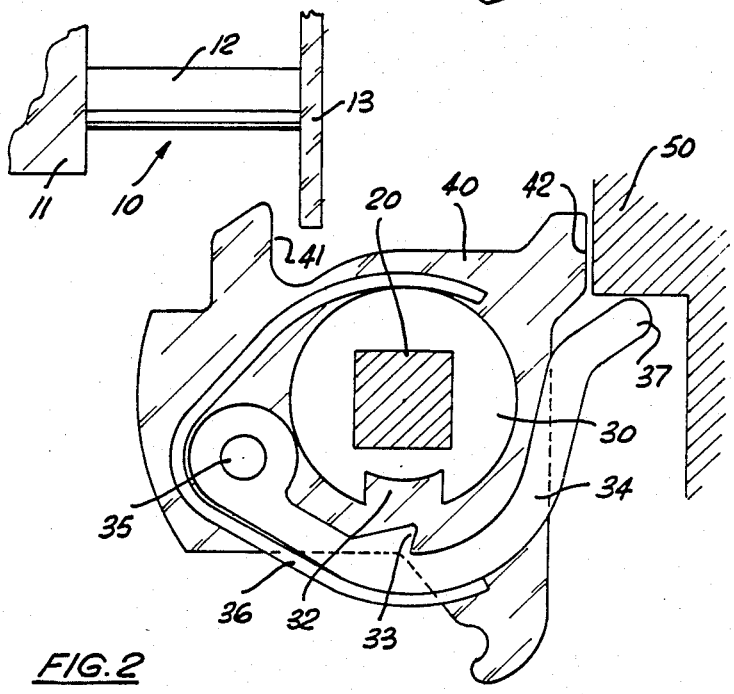
FIG. 2 shows the embodiment of FIG. 1 in a latched locked configuration.

Lever 34 is biased towards boss 30 by means of spring 36 whereby detente 33 is brought into abutting engagement with a wall of recess 32. When the door handle spindle 20 is rotated detente 33, which is engaged to cam 40 is then rotated with plug 30. Cam 40 is provided with a profile including a pawl portion 41 which acts against bracket 13 of latch bolt 10 to withdraw or retract bolt 10 when cam 40 is rotated anti-clockwise as illustrated in FIG. 1. Boss 30 is thus a first part adapted in use to be rotated by a door handle via spindle 20. Cam 40 is a second part adapted by means of pawl portion 41 to drive the latch bolt. Lever 34 with detente 33 is engageable and disengageable from the recess 32 of plug 30 thereby comprising a clutch means. When the detente 33 is disengaged from recess 32, boss 30 is freely rotatable by the spindle 20. With reference to FIGS. 1 and 2 there is further provided a lock mechanism of which only snib 50 is shown in the drawings. The lock may for example be a cylinder lock and snib 50 may be driven between an upper unlocked position as shown in FIG. 1 and a lower locked position as shown in FIG. 2 in which snib 50 is brought adjacent a striker 42 of cam 40. In the locked configuration cam 40 is immobilized since any rotation of cam 40 would bring striker 42 into abutment with lock snib 50.

While in the locked position, snib 50 drives the distal end 37 of lever 34 so as to disengage detente 33 from recess 32 thereby permitting free rotation of boss 30 with respect to immobilized cam 40. Thus while snib 50 is in the locked position and the latch bolt is immobilized in the latched position, the door handle spindle is freely rotatable and the lock mechanism cannot be damaged by torque applied to the handle externally of the lock. When the lock is returned to an unlocked position and snib 50 is raised spring 36 biases lever 34 and detente 33 to reengage recess 32 of boss 30. It may be necessary to rotate boss 30 in order to bring about reengagement and boss 30 may if desired be provided with a plurality of recesses 32 spaced apart about the circumference. Cam 40 may then be driven to retract bolt 10 by rotation of spindle 20.

Figure 3:
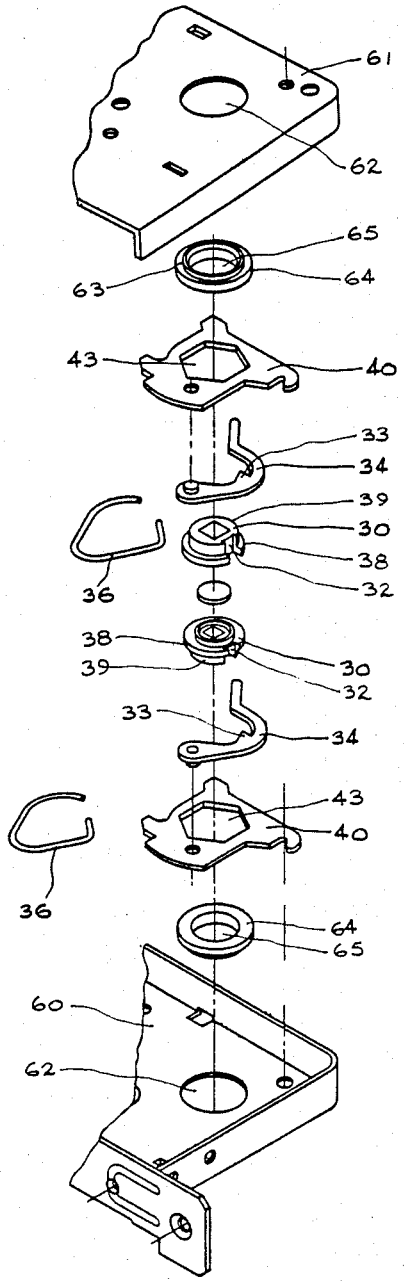
FIG. 3 shows a schematc exploded view of part of a 3000 series door lock fitted with an embodiment of the present invention.

As seen in FIG. 3, the present invention may be fitted to a substantially conventional 3000 series door lock manufactured by the applicant. For the purposes of clarity only the components required to understand the operation of the present invention are illustrated. The door lock includes two arrangements similar to that described above with reference to FIGS. 1 and 2. This permits optional independent locking from either side of a door fitted with the lock.

As seen in FIG. 3, the 3000 series door lock has a two-piece case comprising a first side 60 and a second side 61. Each side 60, 61 has a circular aperture 62 to receive the locating projection 63 of a bearing insert 64. The bosses 30 comprises a flange portion 38 and a stepped portion 39 of lesser diameter. Cam 40 has a central hexagonal aperture 43 and the distance between opposite sides of the hexagon is slightly greater than the diameter of the stepped portion 39 so that the cam 40 can be rotatably mounted on the boss 30 abutting the flange portion 38.

The cylindrical hole 65 in the bearing insert 64 has a diameter slightly greater than the diameter of the stepped portion 39 of boss 30. This permits the end of stepped portion 39 to be inserted into bearing portion 64 whilst cam 40 is rotatably mounted thereon. The bosses 30 are suitably dimensioned to locate cam 40 longitudinally to its rotational axis about boss 30 by abutment of bearing 64 and flange portion 38 on opposite sides of the cam 40 when the lock case is assembled.

Two separate door spindles (not shown) are inserted from either side of the door lock each to rotate one of the bosses 30. The door spindles are prevented from simultaneously engaging both bosses 30 by a plug 65 fitted between the bosses 30.

The lever 34 is pivotally mounted on cam 40 and resiliently biased toward boss 30 by spring 36 to urge detente 33 into engagement with recess 32, as described above with reference to FIGS. 1 and 2.

The lock snibs which engage the striker of cam 40 and distal end of level 34 as described above are substantially conventional arrangements used in the 3000 series door locks. Similarly, the mechanism by which cam 40 operates the latch bolt of the door lock is also substantially the conventional mechanism used in 3000 series door lock.

It will be understood that locks such as herein described are often sold without a handle so that independently selected door furniture may be mounted to the spindle. Thus references herein to a door handle spindle include a spindle adapted for mounting a door handle thereto as well as to spindles having an integral door handle or a mounted door handle. As will be apparent to those skilled in the art the latch bolt may be driven from a latching to a retracted position by levers or other drive means and clutch means other than herein described may be used to engage or disengage drive between the handle spindle and the latch bolt. It is not essential that the lock snib act to immobilize the cam. The snib may act directly to prevent retraction of the bolt or may act on other parts of the bolt drive system. The snib may be operated by a simple catch or lever or preferably is key operated. The mechanisms described with reference to FIGS. 1, 2 and 3 are highly preferred in that they are compact, robust, and relatively easy to manufacture and assemble compared with other embodiments.

As will be apparent to those skilled in the art from the teaching hereof the invention may be carried into effect in other embodiments and such other embodiments are deemed to be within the scope hereof. The claims defining the invention are as follows:

I claim:

1. A latch lock comprising:

a latch bolt connected for movement between a latching position and a retracted position, a first part connected to be rotated by a door handle, a second part connected to drive said latch bolt between said positions, and clutch means connected between said first and second parts for transmitting rotation of said first part by the door handle to said second part to move said latch bolt to the retracted position when engaged and allowing free rotation of said first part by the door handle when disengaged.

2. A latch lock according to claim 1 further comprising locking means for disengaging said clutch means to prevent movement of the latch bolt when said locking means is in a locked position.

3. A latch lock according to claim 1 or claim 2 wherein the clutch means comprises a lever pivotally connected to the second part, the lever and the first part being provided with interengagable formations engageable with and disengagable from each other by pivotal movement of the lever.

4. A latch lock according to claim 3 further including biased means whereby the lever is biased towards engagement of said interengagable formations.

5. A latch lock according to claim 4 wherein the lever is provided with a spur which engages with a recess formation of the first part.

6. A latch lock according to claim 2 wherein the lever is operated to disengage said formations by the locking means and wherein retraction of the latch bolt is prevented by abutment of the locking means with the second part.

7. A latch lock according to claim 6 wherein the first part includes a boss mounted to the second part for rotation with respect thereto.

* * * * *